US010413795B2

(12) United States Patent
Moore, Jr.

(10) Patent No.: US 10,413,795 B2
(45) Date of Patent: Sep. 17, 2019

(54) BASKETBALL TRAINING DEFENDER-REACH SIMULATOR APPARATUS AND METHOD

(71) Applicant: Clarence Moore, Jr., Larose, LA (US)

(72) Inventor: Clarence Moore, Jr., Larose, LA (US)

( * ) Notice: Subject to any disclaimer, the term of this patent is extended or adjusted under 35 U.S.C. 154(b) by 0 days.

(21) Appl. No.: 15/367,440

(22) Filed: Dec. 2, 2016

(65) Prior Publication Data

US 2017/0312607 A1 Nov. 2, 2017

Related U.S. Application Data

(63) Continuation-in-part of application No. 15/139,532, filed on Apr. 27, 2016, now abandoned.

(51) Int. Cl.
*A63B 69/00* (2006.01)
*A63B 69/34* (2006.01)

(52) U.S. Cl.
CPC ..... *A63B 69/0071* (2013.01); *A63B 69/34* (2013.01); *A63B 2225/093* (2013.01)

(58) Field of Classification Search
CPC ..... A63B 69/0071; A63B 69/0059; A63B 21/065; A63B 21/4007; A63B 63/083; A63B 2243/0037; A63B 2208/0207
See application file for complete search history.

(56) References Cited

U.S. PATENT DOCUMENTS 1,301,276 A * 4/1919 Kroetz ..... A61F 5/028 128/DIG. 23
1,587,605 A * 6/1926 Scroggins ..... A63B 35/00 440/17
2,744,348 A 5/1956 Smith
2,973,030 A * 2/1961 Matthewson ..... A61F 5/055 128/DIG. 23
2,986,314 A * 5/1961 Miller ..... A45F 3/14 224/266
3,675,921 A * 7/1972 Meyers, Sr. ..... A63B 69/0071 473/448
3,868,108 A 2/1975 Kirchner
4,519,608 A * 5/1985 Gilly ..... A63B 69/38 473/215
4,579,341 A * 4/1986 Furr ..... A63B 69/0071 473/450
4,653,750 A * 3/1987 McIntyre ..... A63B 23/03575 128/869
4,911,346 A * 3/1990 Shallman ..... A45F 3/08 224/153

(Continued)

*Primary Examiner* — Melba Bumgarner
*Assistant Examiner* — Amir A Klayman
(74) *Attorney, Agent, or Firm* — Matthew M. Googe; Robinson IP Law, PLLC

(57) ABSTRACT

A basketball-training defender-reach simulator apparatus and method providing a pair of simulated arms and hands constantly upraized in a defensive position, to be worn by a trainer during on-court training in order to condition basketball players to anticipate and counteract the movements of defending guarders, having life-like characteristics of look, feel, posture or positioning, and movement, solving problems of providing training against defending guarders when the trainer is required to use the real arms and hands for other tasks, when the trainer is unable to keep arms raised for extended periods, or when the stature of the trainer prevents reaching a realistic height.

9 Claims, 4 Drawing Sheets

(56) References Cited

U.S. PATENT DOCUMENTS

| | | | | |
|---|---|---|---|---|
| 5,131,576 | A * | 7/1992 | Turnipseed | A45F 3/08 224/262 |
| 5,167,600 | A * | 12/1992 | Baird | A63B 21/065 482/100 |
| 5,527,185 | A * | 6/1996 | Davis | A63B 69/34 434/247 |
| 5,628,443 | A * | 5/1997 | Deutsch | A45C 7/0086 150/113 |
| 5,890,985 | A | 4/1999 | Jenney | |
| 6,622,309 | B1 | 9/2003 | Edmonds | |
| 6,719,640 | B1 * | 4/2004 | Madole | A61F 5/026 473/215 |
| D539,373 | S | 3/2007 | Cook | |
| 8,152,660 | B1 | 4/2012 | Jiminez, Jr. et al. | |
| 8,277,340 | B1 | 10/2012 | Devine | |
| 9,095,755 | B1 * | 8/2015 | Hill | A63B 69/0071 |
| D739,903 | S | 9/2015 | McDonald | |
| 9,498,693 | B1 * | 11/2016 | Kraus | A63B 69/345 |
| 2002/0121742 | A1 * | 9/2002 | Stauber | A63B 69/0024 273/458 |
| 2003/0211906 | A1 | 11/2003 | Seltzer et al. | |
| 2004/0053755 | A1 * | 3/2004 | Wilkinson | A63B 21/153 482/124 |
| 2006/0199676 | A1 | 9/2006 | Ashbaugh | |
| 2009/0098955 | A1 * | 4/2009 | Crook, II | A63B 69/345 473/422 |
| 2011/0111890 | A1 * | 5/2011 | Webb | A63B 69/0002 473/458 |
| 2012/0208660 | A1 | 8/2012 | Mayers | |

* cited by examiner

BASKETBALL TRAINING DEFENDER-REACH SIMULATOR APPARATUS AND METHOD

CROSS-REFERENCE TO RELATED APPLICATIONS

This is a continuation-in-part of U.S. patent application Ser. No. 15/139,532, titled "Basketball Training Defender-Reach Simulator Apparatus and Method," filed Apr. 27, 2016, currently pending, the full text of which is hereby incorporated by reference and priority of which is hereby claimed.

BACKGROUND

This invention provides a basketball-training defender-reach simulator apparatus and method providing a pair of simulated arms and hands constantly upraised in a defensive position.

Good training of a basketball player includes conditioning basketball players to anticipate and counteract the movements of defending guarders, which involves upraised arms and hands trying to block an offensive player's shots of a basketball or to preemptively prevent the offensive player from shooting the ball.

It is therefore desirable for a coach or basketball trainer to simulate the raising of a guarder's hands in the air, to more effectively train an offensive player to account for such guarding. Conventional methods may provide for a mesh netting or standalone post that would block the shooting of a basketball, but such systems are not indicative of actual game situations in which a defender raises its hands in the air.

U.S. Publication No. 2003/0211906 was published Nov. 13, 2003 by Bennie Seltzer et al. on an "Athletic Training Device." The disclosed athletic training device increases the effective height of a defensive player by the use of a blocking device that includes a blocking surface attached to a vertical support that is carried by the defensive player. The vertical support holds the blocking surface elevated above the head of the defensive player. The blocking surface is provided by a substantially planar sheet shaped and/or decorated to be the simulated upper portion of a defensive player with arms extended. The vertical support is held upright by a torso-encircling harness carried by the defensive player. The vertical support includes two telescopically coupled tubes having a locking nut for fixing the degree of telescopic engagement of the two tubes to adjust the height of the blocking surface with respect to the defensive player. According to the disclosure of the Seltzer publication, the height of the blocking surface can be adjusted to accurately simulate the exact height of a particular defensive player. However, the Seltzer device depicts an entire upper torso of the player. It does not provide for the enhancement of the "real" defensive player's physique by adding only a second set of arms in the air, which would mimic a more realistic defensive situation.

U.S. Pat. No. 8,152,660, issued Apr. 10, 2012 to David Jiminez, Jr. et al. on a "Basketball Training Device," covers a basketball training device that simulates the presence of a defensive player, and more specifically the hand of a defensive player, so as to provide practice shooting a basketball with at least a partially restricted view of the basketball goal. The basketball training device further includes a support pad that is releasably secured proximate the lower torso region of the user, utilizing an adjustable strap. Movably connected to the support pad is a first support member and a second support member. The second support member is hinged attached to the first support member. The basketball training device further includes a visual inhibitor movably attached to the second support member opposite the first support member. Operably coupled to the second support member distal to the first support member is an activation cord. The activation cord is further connected at the opposing end to at least one finger of the user's dominant shooting hand. The activation cord will transition the second support member from a first position to a second position, thus placing the visual inhibitor proximate the facial region of the user. However, the Jiminez device is designed to be worn by the offensive player, not a trainer posed as an opposing defending player. It therefore does not provide for a training situation in which a second defensive player, training the offensive player, raises its hands in the air, as would happen in a real basketball game.

U.S. Pat. No. 6,622,309 issued Sep. 23, 2003 to Joseph Edmonds on an "Athletic Face Shield." The Edmonds athletic face shield consists of a head frame that contours to a player's head, along with an elastic headband. The interchangeable hand shield is affixed to the front of the head frame and can be replaced with other objects. The athletic face shield fits in front of the player's face to produce the "hand in your face" effect utilized by defense players. It allows a solitary player to practice his or her defense game and experience the defense hand in the face when shooting. The face shield, made in the shape of a hand, features an interchangeable hand that comes in various sizes to accommodate the user. The hand attaches to a headband-like frame that fits around a player's head, and is designed to substantially block the player's view while shooting a basketball.

U.S. Pat. No. 8,277,340 issued Oct. 2, 2012 to Anthony Devine for a "Basketball Training Device" that mimics an opposing player during practice. The training device has a weighted base set on caster wheels. A vertical support extends upwardly from the base. A slide structure moves up and down on the vertical support between a high position and a low position. A blocking form is coupled to the slide structure. The blocking form moves with the slide structure. Consequently, the blocking form can move up and down. An elongated control rod attaches to the wheeled base. The control rod is used by a coach to push and pull the training device along the basketball court during play. In this manner, the coach can adjust the position of the blocking form to better mimic the movements of a real opposing player. One embodiment of the basketball training device comprises a base; a plurality of caster wheels supporting the base, enabling the base to be rolled in any direction; a vertical support extending upwardly from the base; a slide structure wherein the vertical support extends throughout the slide structure between its front and rear surfaces, enabling the slide structure to freely move up and down; and a blocking form, shaped to depict at least a portion of a basketball player having upstretched arms, coupled to the front surface of the slide structure so that the blocking form moves with the slide structure relative to the vertical support.

U.S. Pat. No. 5,890,985, issued Apr. 6, 1999 to George Warren Jenney, discloses a "Basketball Training Aid." The portable basketball training aid is designed to improve the layer's shooting accuracy while being distracted by vision restrictors that simulate realistic game conditions. The training aid is used in the vicinity of an elevated basketball hoop and board. The training aid includes a plurality of height extendable flexible supports extending upward from the top of the hollow support member in a direction approximately parallel to the support member. The training aid has an upper extent and a lower extent, the lower extent being attached to a compressible anchor member made from any suitable material and shape, such as a foam cylinder. The compressible anchor member is confined within the rigid hollow support member and held in place by friction, the friction being formed at the intersection of the compressible member and the inside wall of the rigid hollow member.

U.S. Pat. No. 2,744,348 issued May 8, 1956 to G. F. Smith on a "Camouflage Holder for Hunting Garments," generally disclosing a strap-like configuration similar to that of the above basketball apparatuses. The Smith invention relates to new and useful improvements in camouflage equipment, and more particularly to a holder for stalks of vegetation adapted for attaching to the back of a hunting coat or other garment to support the stalks in a position for concealing the head and shoulders of the hunter. The camouflage body garment comprises a plurality of rows of tubular members secured to the back of the garment, aligned vertically with respect to each other, the lowermost row of members having closed bottoms, and stalks of vegetation supported in an upstanding position in said members and with the upper ends of said stalks terminating in the region of the head of a person wearing the garment to conceal the upper portion of the body of the person.

U.S. Publication No. 2006/0199676, published Sep. 7, 2006 by Joshua Edwin Ashbaugh for a "Basketball Training Aid," discloses a basketball training device for improving the effectiveness of a defensive basketball player while increasing the challenge to an offensive basketball player. The training device is comprised of a grip handle and a padded cylindrical pole, and attached to the top of the pole is a polyurethane foam hand. The training device is used as an extension of the defensive player's own hand. The device is to be held at the bottom, where the grip handle is located. The defensive player holding the device can then distract the offensive player in a number of ways. Examples include: blocking the offensive player's vision of the basket; attempting to block the offensive player's shot; and attempting to steal the ball from the offensive player while ball handling. This device does not require a defensive player to expend a large amount of energy and makes up for any lack of size or quickness. The device also makes it possible for a person of limited mobility to help an offensive player train and improve perimeter shooting, low post moves, and ball handling.

U.S. Pat. No. 3,868,108, issued Feb. 25, 1975 to Robert L. Kirchner, covers an "Athletic Training Device." The headband-supported device for partially obstructing the field of view of a player is used for the purpose of training athletic competitors to become accustomed to their sight being partially obstructed by opposing competitors. The illustrated obstruction is in the form of a representation of a hand. The athletic training device comprises sight-obstructing means having non-transparent portions, the sight-obstructing means comprising a representation of a hand with spread-apart fingers, and mounting means for removably supporting the sight-obstructing means on the head of a user, with the non-transparent portions in the field of view of the user's eyes.

SUMMARY OF THE INVENTION

This invention is a basketball-training defender-reach simulator apparatus and method providing a pair of simulated arms and hands constantly upraised in a defensive position, to be worn by a trainer during on-court training in order to condition basketball players to anticipate and counteract the movements of defending guarders, having life-like characteristics of look, feel, posture or positioning, and movement.

This invention solves a problem of providing training against defending guarders when the trainer is required to use the real arms and hands for other tasks, when the trainer is unable to keep arms raised for extended periods, or when the stature of the trainer prevents reaching a realistic height.

BRIEF DESCRIPTION OF DRAWINGS

Reference will now be made to the drawings, wherein like parts are designated by like numerals, and wherein.

DETAILED DESCRIPTION OF THE INVENTION

Figure 1:
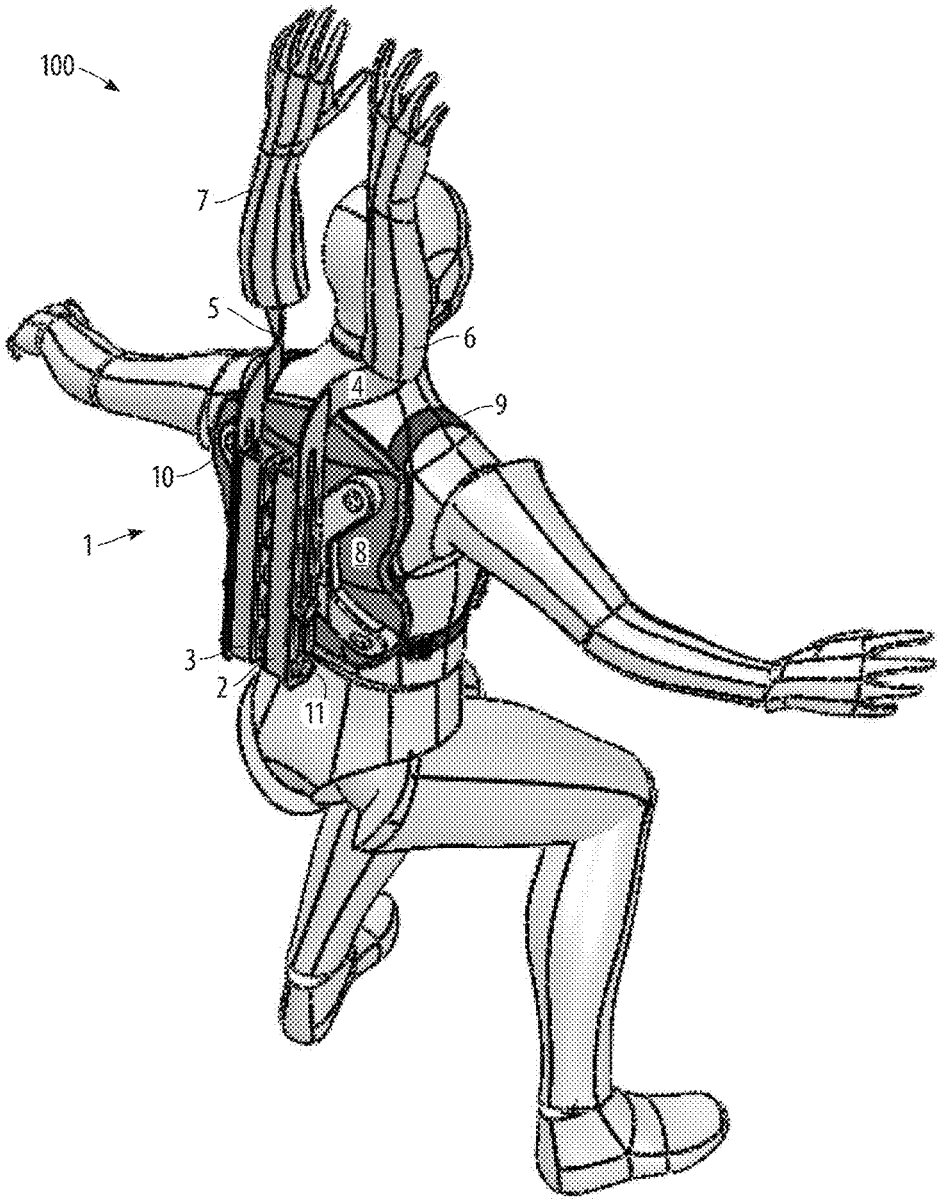
FIG. 1 is a perspective back view of the basketball-training defender-reach simulator in use worn by a trainer.
Figure 2:
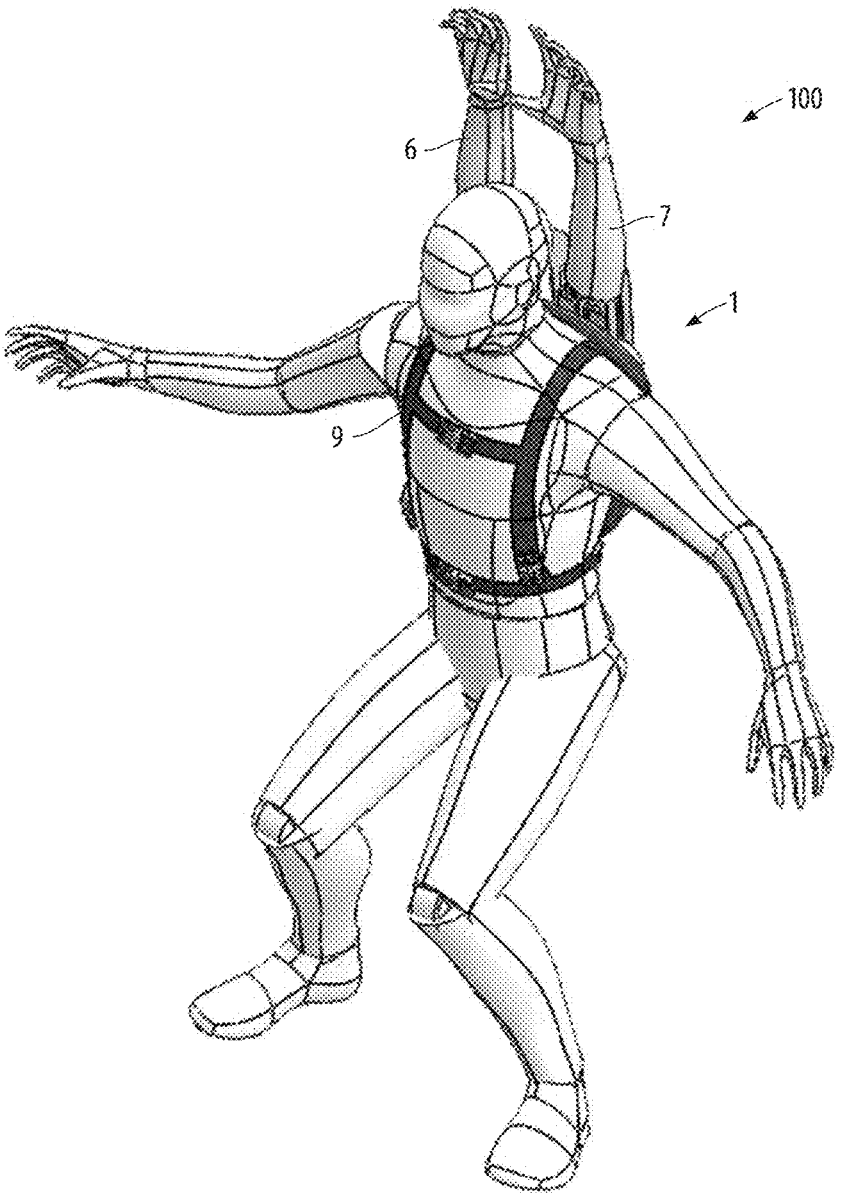
FIG. 2 is a perspective front view of the basketball-training defender-reach simulator in use worn by a trainer.
Figure 3:
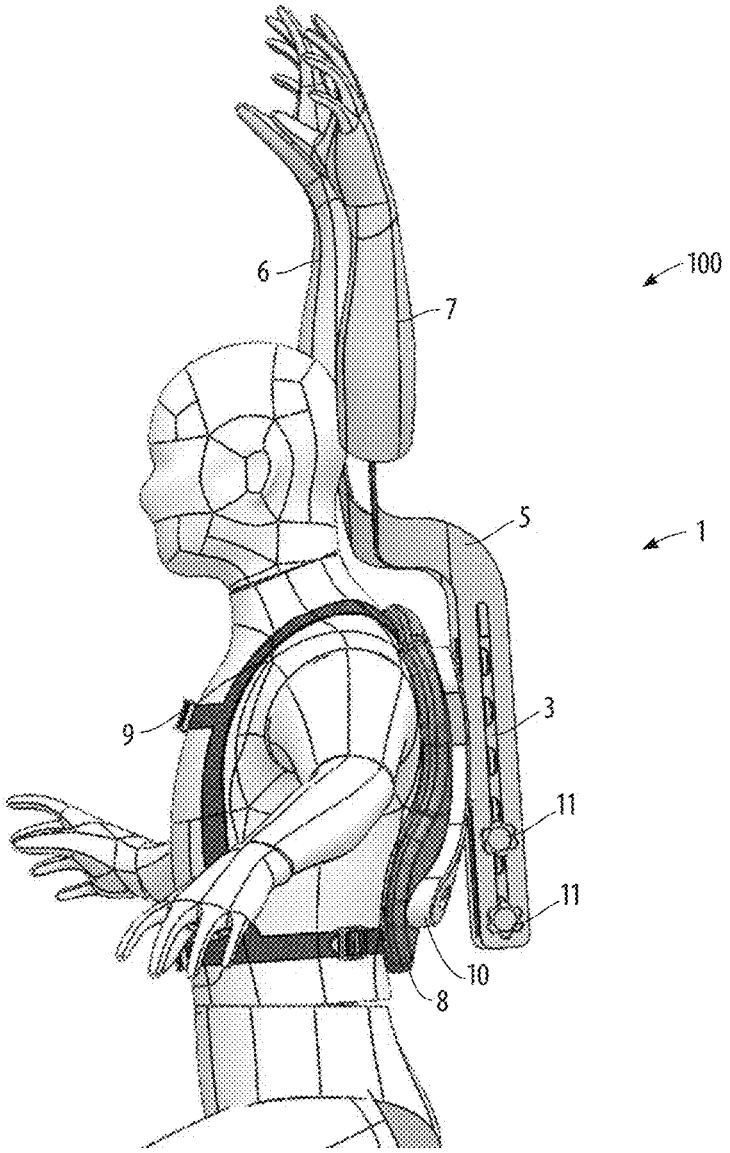
FIG. 3 is a left side view of the basketball-training defender-reach simulator in use worn by a trainer.
Figure 4:
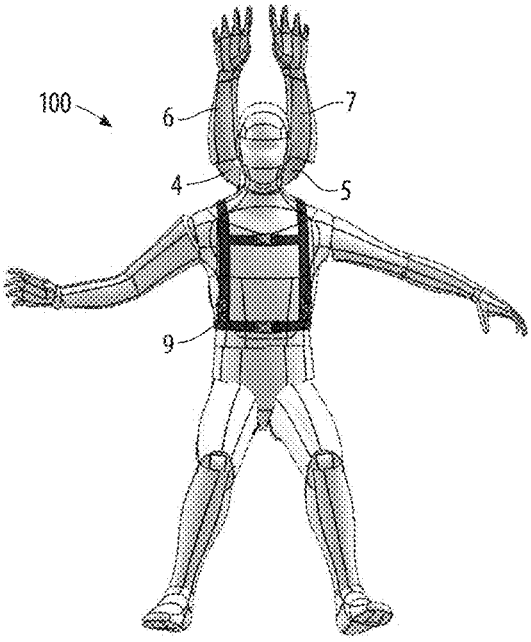
FIG. 4 is a front view of the basketball-training defender-reach simulator in use worn by a trainer.
Figure 5:
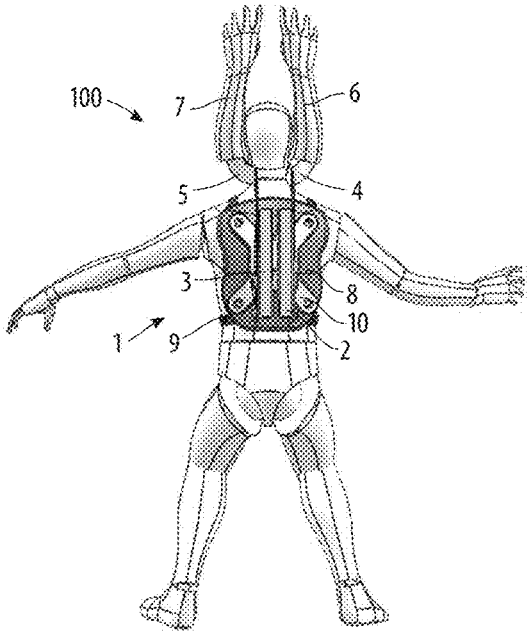
FIG. 5 is a back view of the basketball-training defender-reach simulator in use worn by a trainer.
Figure 6:
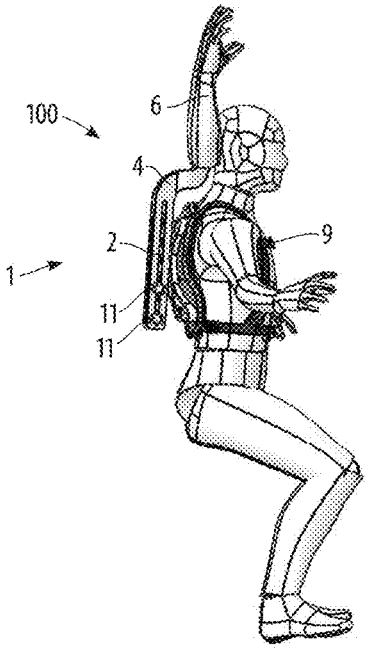
FIG. 6 is a right side view of the basketball-training defender-reach simulator in use worn by a trainer.
Figure 7:
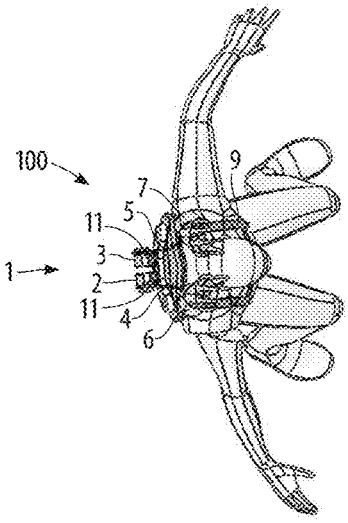
FIG. 7 is a top view of the basketball-training defender-reach simulator in use worn by a trainer.

Referring to all figures generally, an embodiment of the basketball-training defender-reach simulator method and apparatus 100 is illustrated.

The basketball training defender-reach simulator 100 provides a torso unit 1 to be worn on the torso of the trainer. It is desirable that the trainer's movements be conveyed to the basketball-training defender-reach simulator 100, so the vest can either be made of a semi-rigid material that will be moved by the trainer's movements within it, or made of a flexible material that is worn tightly against the trainer's torso.

The torso unit 1 has a cross brace 10 which, in use, conforms to the concave curve of the trainer's back by the placement of the upper ends in relation to the trainer's shoulders and of the lower ends in relation to the trainer's middle back, and provides an essentially vertical surface at the central portion when the trainer is standing straight. The cross brace is attached to a cushioned back pad 8 which separates the stiff cross brace 10 from the trainer's upper and middle back. The cushioned back pad 8 prevents the stiff cross brace 10 from digging into the trainer's back, and also provides for a slight amount of movement and springiness of the cross brace 10 in relation to the trainer's torso when in use. The cushioned back pad 8 with the attached cross brace 10 is adjustably and removably secured to the trainer's torso by a harness 9, as shown.

Affixed to the back of the torso unit 1, at the vertical, central portion of the cross brace 10 are a right mount rail 2 and a left mount rail 3. The mount rails 2, 3 are meant to have an essentially vertical orientation when in use by a standing trainer. The mount rails are meant to provide mounting points for the right and left bars 4, 5 to which are affixed the right and left simulated arms 6, 7. A right bar 4 and a left bar 5 are provided for the adjustable mounting of simulated arms and hands. The right and left bars 4, 5 correspond to the right and left mount rails 2, 3. Significant rotation of the bars 4, 5 and attached simulated arms 6, 7 is prevented by having one or more flat sides on the bars, with corresponding flat sides on the mount rails 2, 3. The bars 4, 5 are optimally made of material that is able to be temporarily bent by a slight amount, with shape retention to allow a return to position. Such slight bending contributes to a realistic movement of the basketball-training defender-reach simulator 100 in response to a trainer's movement. A more rigid material could be used as well. The right and left bars 4, 5 are adjustably mounted on the right and left mount rails 2, 3 in such a way that the vertical extension of the simulated arms 6, 7 can be adjusted in relation to the height of any given trainer. Many basketball players are tall, and a realistic training regime will use the basketball-training defender-reach simulator at a realistically representative height, which might be higher or lower in relation to the shoulders and stature of any given trainer. In an embodiment, the adjustable mounting is effected with threaded knobs 11 passing through openings in the right and left bars 4, 5 and engaging with corresponding threaded portions of the mount rails 2, 3.

Securely attached to the respective right and left bars 4, 5 are the right simulated arm 6 and left simulated arm 7. The attachment is made at the top of the right and left bars 4, 5 and the bottom, or toward-the-elbow end of the simulated arms 6, 7, so that the resulting combination has a long axis running essentially vertically from the bottom of the bars and continuing through the simulated arm to the simulated hand at the top. The simulated arms 6, 7 are made of materials that simulate the look, feel, and movement of real arms and hands. An interior structure corresponds to the skeletal bones, and an exterior surface corresponds to flesh. The interior structure can be made of wooden sticks or dowels, or of the corresponding forms of metal such as aluminum or sufficiently rigid plastic. The exterior surface can be made of a plastic foam having a moderate amount of flexibility and shape-retaining properties that allow a return to form after slight deformation. The exterior surface can comprise more than one material, such as a latex or polyurethane skin over a closed-cell-foam musculature. It is desirable to make the basketball-training defender-reach simulator as realistic as possible regarding look, feel, and movement, in order to better condition basketball players against actual defenders. In a preferred embodiment, the simulated arms 6, 7 are made with reference to casts taken of actual arms and hands.

In embodiments where the right and left bars 4, 5 present substantial flat faces only sufficient to stabilize flexing in one direction, the bars 4, 5 can be twisted about their axes to stabilize flexing in another direction.

The right and left mount rails 2, 3 are affixed close to each other and close to the center line of the torso unit 1, so that movement of the simulated arms 6, 7 tracks the center of the back of the trainer. The desired spacing of the simulated arms 6, 7, when in use, is wider than the spacing of the left and right mount rails 2, 3. Also, the location of the mount rails 2, 3 stands off from the back of the trainer by the combined thickness of the cross brace 10 and the cushioned back pad 8. A straight extension upward from the mount rails 2, 3 would place the simulated arms 6, 7 too far back from a natural position above the shoulders. In moving the simulated arms 6, 7 outward and forward, care must be taken to avoid placing any structural component in a place that would not be occupied by a real raising of the arms. In other words, the right and left bars 4, 5 must not block any area that real raised arms would not block. In an embodiment of the basketball training defender-reach simulator 100 of the invention, the right and left bars 4, 5 are provided with a combination of curves or bends which offset the simulated arms 6, 7 forward and away from each other, while providing greater forward-backward stability near the mount rails 2, 3 and greater side-to-side stability near the simulated arms 6, 7. As a consequence, a slight amount of side-to-side flex is allowed near the mount rails 2, 3 and a slight amount of forward-backward flex is allowed near the elbow ends of the simulated arms 6, 7.

Many changes and modifications can be made in the present invention without departing from the spirit thereof. I therefore pray that rights to the present invention be limited only by the scope of the appended claims.

What is claimed is:

1. A basketball-training defender-reach simulator apparatus to be worn on a torso of a trainer having a standing posture with shoulders above the pelvis, the basketball-training defender-reach simulator comprising:

a torso unit adapted to fit about the torso of the trainer, the torso unit having:

(a) a cushioned back pad adapted to conform to a back of the trainer's torso;

(b) an X-shaped rigid cross brace attached across the cushioned back pad and adapted to conform to the back of the torso of the trainer; and (c) a harness attached to the cushioned back pad, adapted to encompass the trainer's torso and to couple movement of said torso unit with movement of the trainer's torso;

(ii) a right mount rail affixed to the rigid cross brace and a left mount rail affixed to the rigid cross brace, the right mount rail and left mount rail arrayed vertically and parallel each to the other on the torso unit;

(iii) a right simulated arm and a left simulated arm each having a hand end and an elbow end; and (iv) a right bar and a left bar securely and adjustably attached to said right mount rail and said left mount rail at a lower section of the right bar and left bar, and to said right simulated arm and left simulated arm at the elbow end of the right simulated arm and left simulated arm, adapted to provide resiliently flexible support to said simulated arms above the shoulders of the trainer;

wherein the right bar and left bar and the right and left simulated arms attached thereto are coupled to the rigid cross brace with the right mount rail and left mount rail respectively; and wherein the right and left simulated arms are independently adjustably attached via said right and left bars to said right and left mount rails on said torso unit such that said right and left simulated arms extend essentially vertically above and are independently adjustable relative to the trainer's shoulders in positions simulating upraised arms.

2. The basketball-training defender-reach simulator apparatus of claim 1, where the adjustable attachment of said right bar and left bar to said right mount rail and left mount rails further comprise provision for increasing and decreasing the heights of said simulated arms above the top of said torso unit.

3. The basketball-training defender-reach simulator apparatus of claim 1, where the interior structure of said right and left simulated arm is made of wooden sticks.

4. The basketball-training defender-reach simulator apparatus of claim 1, where the interior structure of said right and left simulated arm is made of plastic.

5. The basketball-training defender-reach simulator apparatus of claim 1, where the interior structure of said right and left simulated arm is made of metal.

6. The basketball-training defender-reach simulator apparatus of claim 1, where the exterior structure of said right and left simulated arm is made of plastic foam.

7. The basketball-training defender-reach simulator apparatus of claim 1, where said right and left bar further comprise a bar having a wide, short cross section.

8. The basketball-training defender-reach simulator apparatus of claim 1, where said right and left bar further comprise a forward bend such that the right simulated arm and left simulated arm are located above the shoulders of the trainer.

9. The basketball-training defender-reach simulator apparatus of claim 1, where said right and left simulated arm is made from casts taken from real arms and hands.

* * * * *